US008277180B2

(12) United States Patent
Blass et al.

(10) Patent No.: US 8,277,180 B2
(45) Date of Patent: Oct. 2, 2012

(54) AXIAL FAN FOR CONVEYING COOLING AIR FOR A COOLING DEVICE OF A MOTOR VEHICLE

(75) Inventors: Uwe Blass, Moeglingen (DE); Ulrich Vollert, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 793 days.

(21) Appl. No.: 12/441,755

(22) PCT Filed: Sep. 17, 2007

(86) PCT No.: PCT/EP2007/008055

§ 371 (c)(1),
(2), (4) Date: Mar. 18, 2009

(87) PCT Pub. No.: WO2008/040443

PCT Pub. Date: Apr. 10, 2008

(65) Prior Publication Data

US 2010/0014967 A1 Jan. 21, 2010

(30) Foreign Application Priority Data

Oct. 4, 2006 (DE) ..... 10 2006 047 236

(51) Int. Cl.
*F03B 3/04* (2006.01)

(52) U.S. Cl. ..... 415/220; 415/228; 415/173.6; 416/189; 416/169 A

(58) Field of Classification Search ..... 415/219.1, 415/220, 228, 173.6; 416/189, 169 A
See application file for complete search history.

(56) References Cited

U.S. PATENT DOCUMENTS

| | | | | |
|---|---|---|---|---|
| 4,329,946 | A * | 5/1982 | Longhouse | 123/41.49 |
| 4,566,852 | A | 1/1986 | Hauser | |
| 5,701,854 | A | 12/1997 | Hauser | |
| 5,957,661 | A | 9/1999 | Hunt et al. | |
| 6,027,307 | A | 2/2000 | Cho et al. | |
| 2003/0059297 | A1 | 3/2003 | Stagg | |
| 2005/0074333 | A1 * | 4/2005 | Iwasaki et al. | 416/179 |

FOREIGN PATENT DOCUMENTS

| | | |
|---|---|---|
| DE | 33 04 297 | 5/1988 |
| DE | 90 16 496 | 4/1991 |
| DE | 90 17 417.8 | 4/1991 |
| DE | 44 38 184 | 4/1996 |
| DE | 695 24 169 | 7/2002 |
| DE | 101 35 698 | 2/2003 |
| DE | 10206 037 628 | 2/2008 |
| EP | 0 703 367 | 3/1996 |
| GB | 2 406 620 | 4/2005 |
| WO | WO 85/02889 | 7/1985 |

* cited by examiner

*Primary Examiner* — Ross Gushi
(74) *Attorney, Agent, or Firm* — Leydig, Voit & Mayer, Ltd.

(57) ABSTRACT

The invention relates to an axial fan (1) for conveying cooling air for a cooling device of a motor vehicle, wherein the axial fan (1) has axial vanes (4) each having a front edge (4*a*) and a rear edge (4*b*), a van tip (4*c*) and a circumferential ring (5) which is connected to the vane tips (4*c*) and has an approach edge (5*a*) and a dispersing edge (5*b*). It is proposed that the approach edge (5*a*) of the circumferential rind (5) is set back in the flow direction (L) in relation to the front edges (4*a*) of the axial vanes (4).

9 Claims, 4 Drawing Sheets

AXIAL FAN FOR CONVEYING COOLING AIR FOR A COOLING DEVICE OF A MOTOR VEHICLE

Figures 1, 2, 3:
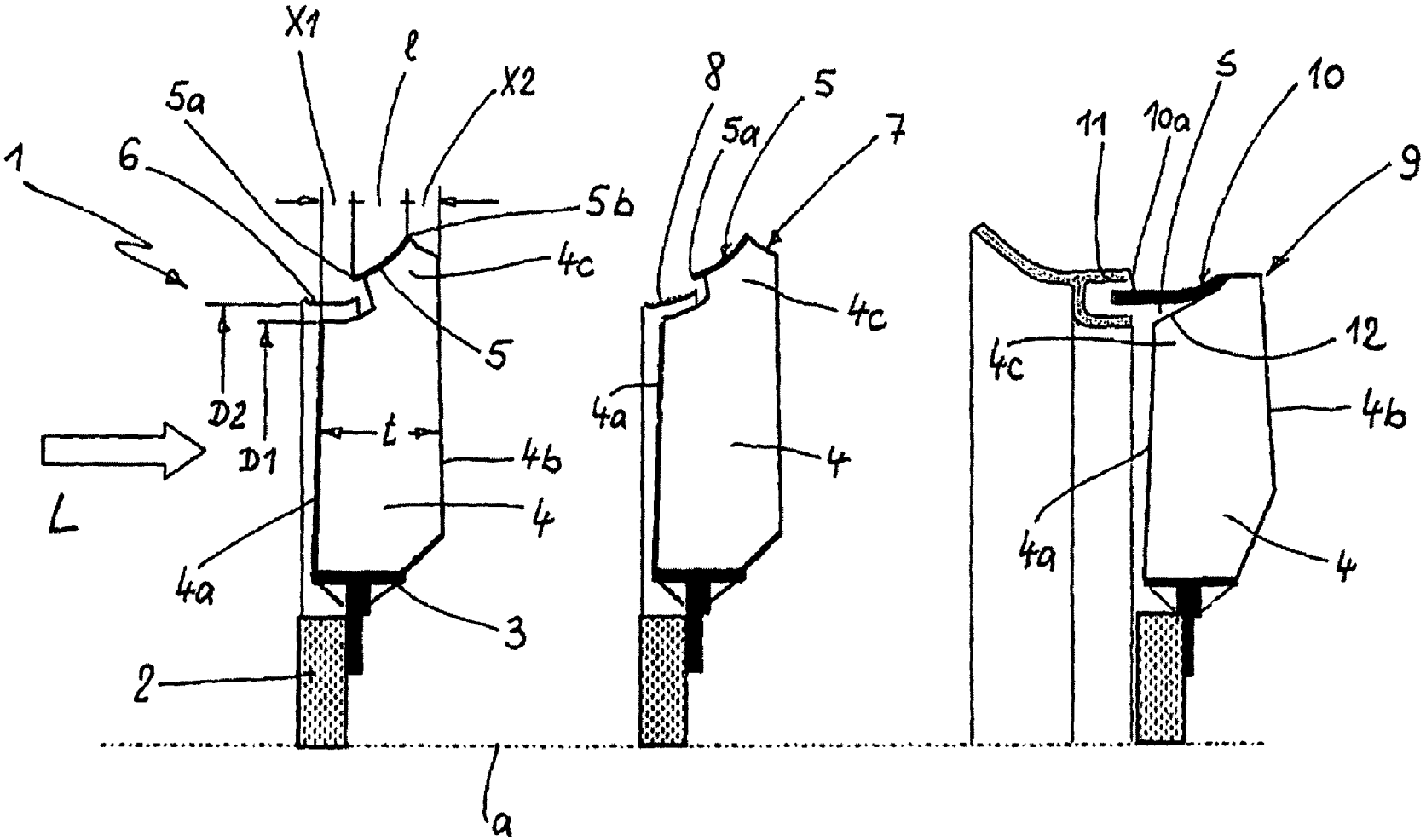

The invention pertains to an axial fan according to the preamble of claim 1, as well as to an axial fan with an inlet nozzle.

Axial fans for conveying cooling air for cooling devices, particularly cooling modules in motor vehicles, are generally known, e.g., in the form of axial fans with free-standing vane tips that revolve in a stationary cowl ring of a radiator cowl. There also exist so-called ducted fans, in which a shroud is connected to the vane tips of the fan vanes and revolves with the fan. Due to the revolving shroud, vane tip losses caused by a flow around the vane tips due to the pressure difference between the pressure side and the suction side of the fan vanes are avoided. In larger motor vehicles, particularly in utility vehicles, the fan is driven by the internal combustion engine of the motor vehicle and supported with respect to the block of the internal combustion engine. The cooling device, in contrast, consists of heat exchangers such as, e.g., coolant cooler or charge intercoolers and is supported on the vehicle, whereas the motor is elastically supported on the vehicle frame. This results in relative movements between the fan and the cooling device or the radiator cowl fixed to the cooling device. Consequently, the relative movement between the components that are rigidly mounted on the engine such as, e.g., the fan and the components that are rigidly mounted on the vehicle such as, e.g., the radiator cowl or the radiator cowl ring are compensated with elastic, flexible compensating elements.

DE 44 38 184 C1 of the applicant discloses a cooling device with an axial fan that is driven by and supported on the engine, where this axial fan revolves in a cowl ring that is rigidly mounted on the engine. A cooling device that is arranged upstream of the axial fan relative to the flow direction and that consists of a radiator with a radiator or fan cowl is connected to the stationary cowl ring by means of an elastic annular lip seal. A bypass flow is superimposed on the fan flow, i.e., the main flow generated by the fan, in the vane tip region. The axial installation depth of the known cooling device is relatively large, particularly due to the annular bypass channel that is arranged upstream of the fan and that generates the bypass flow.

DE 33 04 297 C2 of the applicant discloses a so-called ducted fan with inlet nozzle, wherein the fan and the inlet nozzle are supported on the engine, i.e., on the internal combustion engine of the motor vehicle. The shroud is fixed on axial vanes of the fan and projects into the inlet nozzle with a cylindrical region that is extended forward so that a gap flow with a 180° deflection from the pressure side of the fan to the suction side is generated. Due to the upstream inlet nozzle, this fan also has a relatively large axial installation depth. In addition, the effective fan cross section is reduced by the inlet nozzle that projects radially inward such that the output of the fan is limited.

In today's motor vehicles, minimal installation space is available for the installation of cooling devices and their fans, whereby the demands placed on the cooling capacity to be generated and hence also on the fan output, simultaneously increase.

The invention is based on the objective of improving an axial fan of the initially cited type with respect to its output within a limited installation space.

This objective is realized with the characteristics of claim 1, wherein advantageous embodiments of the invention are disclosed in the dependent claims.

According to the invention, the inflow edge of the shroud is set back relative to the leading edges of the fan vanes (in the following also referred to as fan vanes) in the flow direction, i.e., the shroud ring only extends over part of the fan vane depth in the axial direction, namely over the part situated downstream. A stationary guide ring that preferably has a reduced diameter relative to the shroud ring is preferably arranged in this region, in which the shroud is set back. The stationary cowl ring therefore is arranged upstream of the shroud ring relative to the flow direction and radially within the shroud ring. This provides the advantage of stabilizing the flow in the vane tip region, wherein this is associated with an increased efficiency and a reduced noise development.

According to preferred embodiments of the invention, the cowl ring may be essentially realized cylindrically or conically with an extension in the flow direction or with a bell-shaped or funnel-shaped inlet region that is preferably arranged offset relative to the fan inflow edges opposite to the flow direction.

According to another preferred embodiment, a deflecting element is arranged on the cowl ring in the region of the inflow edge of the shroud ring, wherein said deflecting element generates a gap flow that is directed opposite to the main flow through the axial fan. The annular deflecting element is preferably extended with an annular surface that extends in the flow direction of the main flow and forms an annular gap together with the outer surface area of the shroud ring. This promotes the formation of an effective gap flow that stabilizes the main flow in the vane tip region, i.e., within the shroud. In addition, a radial outflow of the exit flow is promoted with a shroud ring that widens in the downstream direction and an annular surface that widens in parallel fashion. This is particularly advantageous if the installation space is axially limited—due to the engine block of the motor vehicle arranged downstream of the fan.

In order to further promote a radial outflow, flow guide elements that are preferably realized in the form of a radial discharge nozzle may be provided on the annular surface as described in the older application of the applicant with the official file number xy . . . (reference of the applicant: 06-B-060). Due to the setback of the shroud relative to the leading vane edges, the invention with the above-described embodiments therefore merely proposes a partial shrouding of the fan vanes relative to the vane depth, with the stationary cowl ring being arranged in the unshrouded region, namely the region of the setback. The advantages thereby achieved can be seen in the additional axial installation space—relative to a ducted fan with inlet nozzle according to the prior art—and in a stabilization of the main flow.

The inventive axial fan features a projecting shroud ring that projects into the inlet nozzle such that the gap flow known from the prior art with a 180° deflection is realized to stabilize the flow. In order to prevent an incorrect inflow, the axial fan of the invention features a free-standing leading edge and vane tip edge, i.e., a gap in the form of a wedge remains between the vane tip region on the inflow side and the inner surface of the shroud ring. Consequently, a superior inflow, i.e., with fewer losses resulting from an incorrect inflow due to the gap or nozzle flow, can be achieved in the leading and outermost region of the fan vanes. The incorrect inflow is caused in that the speed of the gap or nozzle flow is higher than that of the main flow and furthermore has a circumferential component. Therefore, a disadvantage of the prior art is eliminated with a free leading vane tip edge. However, the stabilizing effect of the nozzle flow is preserved.

Figures 4, 5, 6:
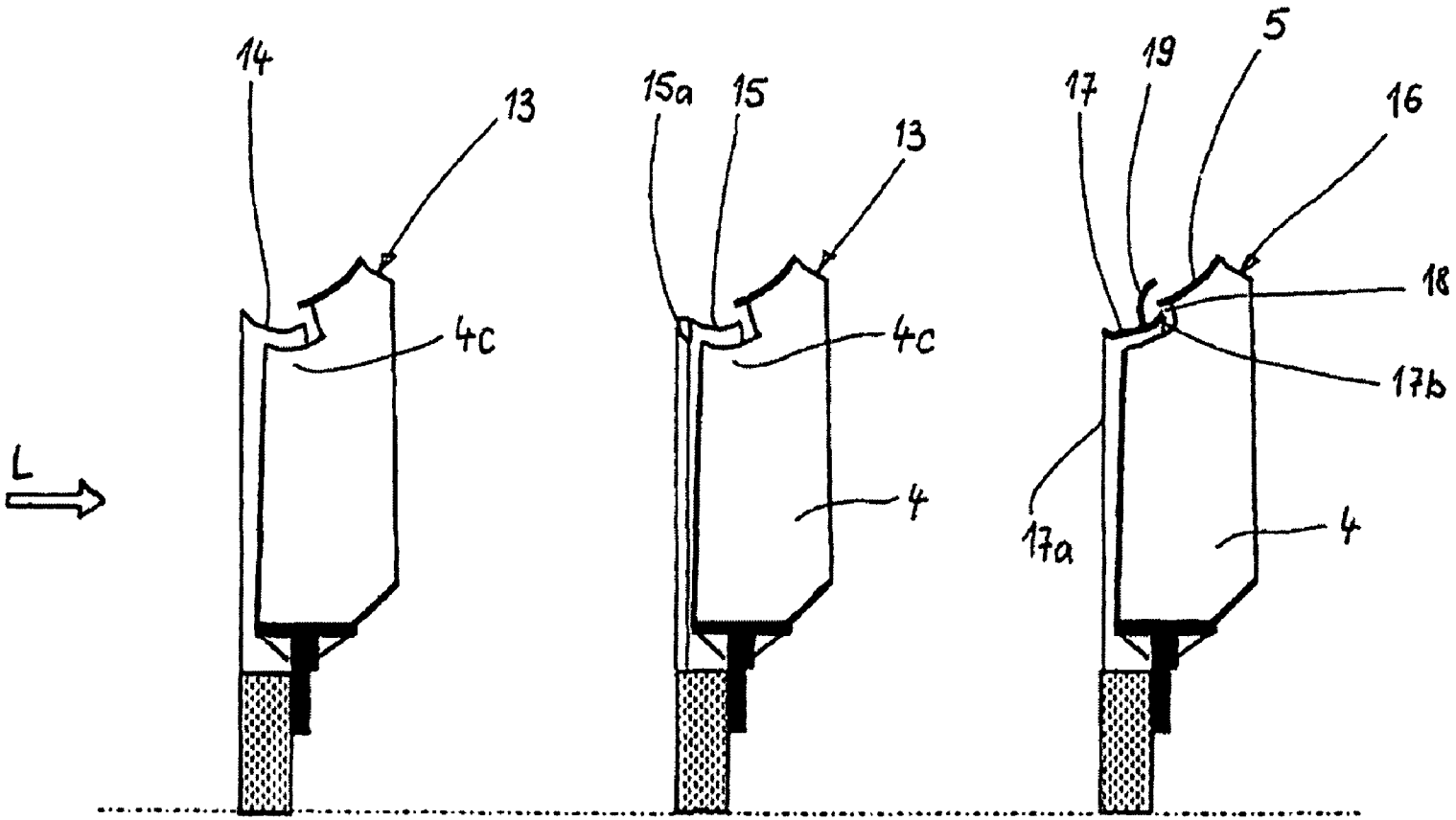
Figure 8:
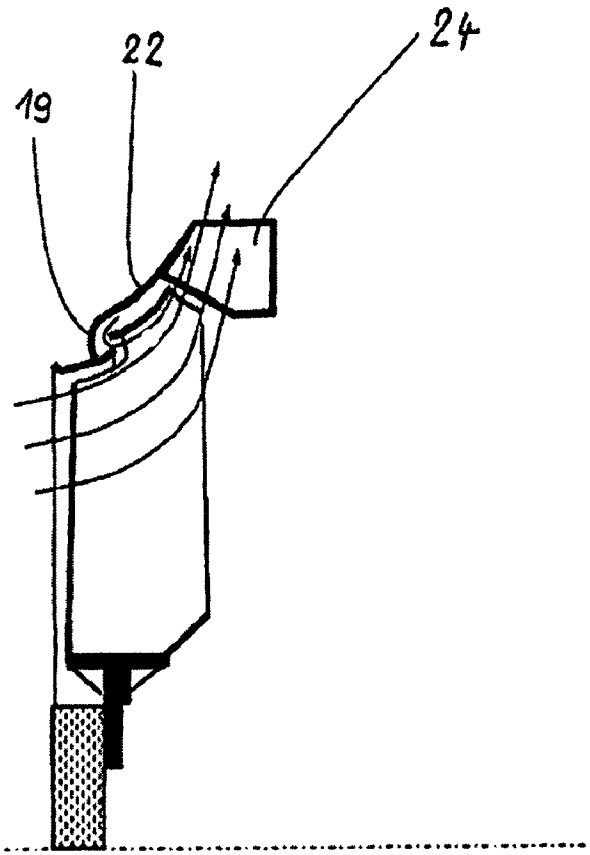
Figure 7:
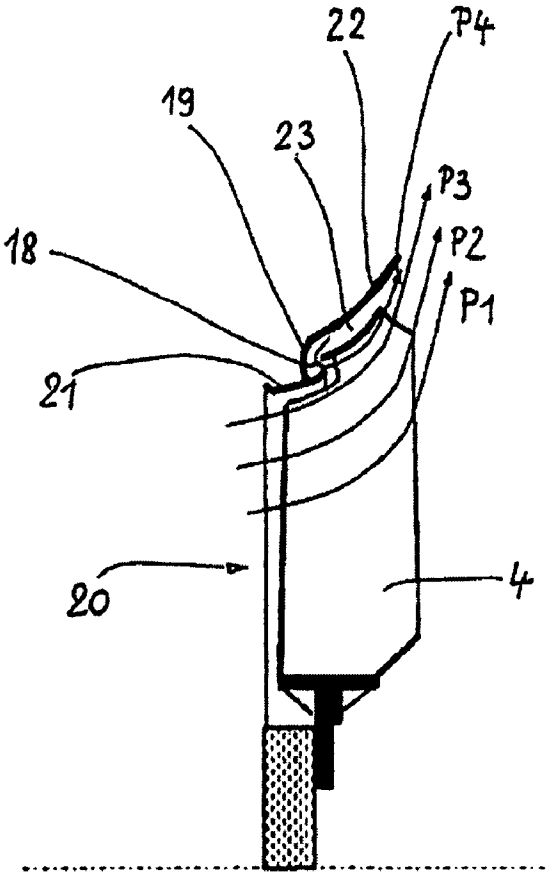
Figure 11:
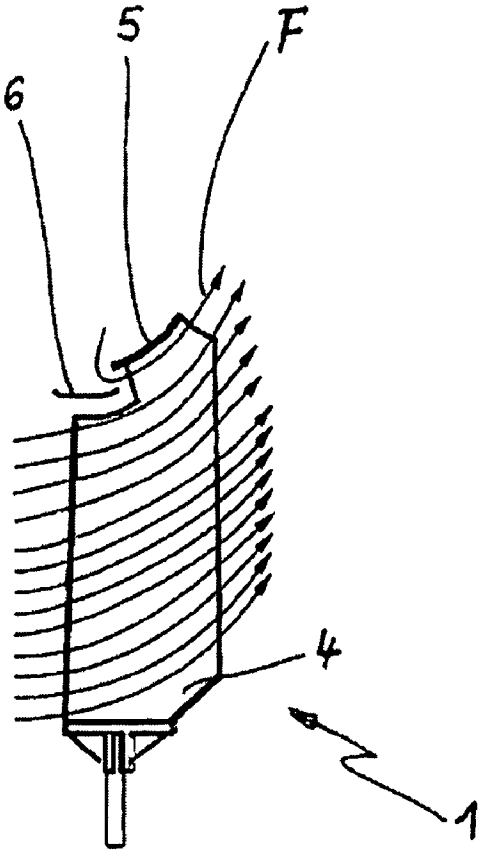
Figure 10:
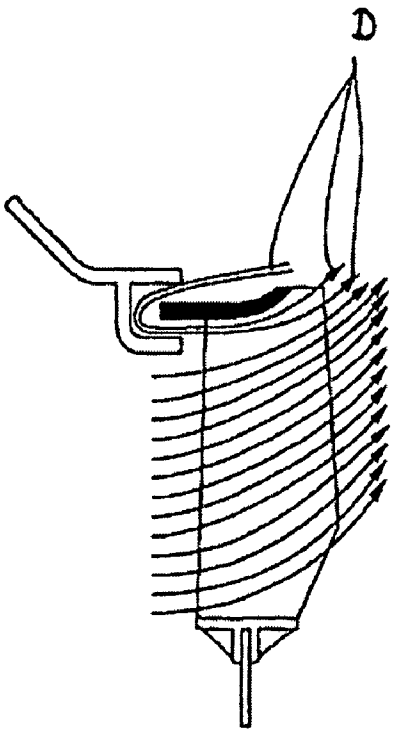
Fig. 10 (Prior art)
Figure 9:
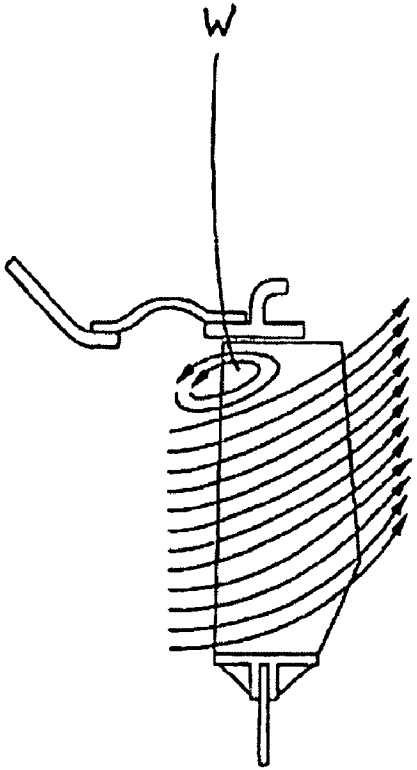
Fig. 9 (Prior art)

Embodiment examples of the invention are illustrated in the drawing and are described in greater detail below. It shows:

FIG. 1, a first embodiment example of the invention in the form of an axial fan with a set-back shroud ring and a stationary cowl ring;

FIG. 2, a variant of the embodiment example according to FIG. 1;

FIG. 3, another embodiment example of the invention with a ducted fan and an inlet nozzle;

FIG. 4, a variant of the embodiment example according to FIG. 1;

FIG. 5, another variant of the embodiment example according to FIG. 1;

FIG. 6, another embodiment example of the invention with an annular deflection element arranged on the guide ring;

FIG. 7, an additional refinement of the embodiment example according to FIG. 6;

FIG. 8, an additional refinement of the embodiment example according to FIG. 7;

FIG. 9, an illustration of the fan flow for an axial fan according to the prior art;

FIG. 10, an illustration of the main flow and the gap flow in a ducted fan with inlet nozzle according to the prior art, and FIG. 11, an illustration of the main flow and the gap flow in an inventive axial fan.

FIG. 1 shows an axial fan 1 that is supported relative to a (not-shown) internal combustion engine of a motor vehicle by means of a clutch 2, preferably a viscous friction clutch, and driven by this internal combustion engine. The axial fan 1 forms part of a cooling device that may feature (not-shown) heat exchangers such as, e.g., a coolant cooler, a charge intercooler or a coolant condenser. Air flows into the axial fan 1 in the direction of the arrow L, where the axial fan is preferably arranged downstream of the (not-shown) heat exchangers relative to the flow direction and takes in ambient air through the heat exchangers. In this case, the axial fan 1 is connected to the upstream heat exchangers by means of a (not-shown) radiator cowl that serves for conveying cooling air. The axial fan 1 features a hub 3 that is connected to the clutch 2, as well as axial vanes 4 with a leading edge 4*a* and a trailing edge 4*b*. The axis of rotation of the fan is designated by reference symbol a. The axial vanes 4 have a vane depth t that extends from the leading edge 4*a* to the trailing edge 4*b*. The vanes 4 feature vane tips (vane tips) 4*c*, on which a shroud ring 5 with an inflow edge 5*a* and an outflow edge 5*b* is fixed. The inflow edge 5*a* is offset relative to the leading edges 4*a* of the fan vanes 4 in the flow direction L by a distance X1 while the outflow edge 5*b* is offset relative to the trailing edge 4*b* opposite to the flow direction by a distance X2. Consequently, the axial dimension I of the shroud ring 5 is smaller than the vane depth t. The region of the vane tips 4*c* that is located upstream of the inflow edge 5*a* relative to the flow direction, i.e., the region X1 of the setback of the inflow edge 5*a*, has a reduced diameter D1. In this way, a corner region of the vane tips 4*c* is recessed, in which a stationary guide ring 6 is arranged, wherein the guide ring 6 has an average diameter D2 that is larger than the diameter D1 but smaller than the diameter of the inflow edge 5*a*. The essentially cylindrical guide ring 6 overlaps the axial vanes 4 in the axial direction and slightly projects relative to the leading edges 4*a*, i.e., opposite to the flow direction L. The guide ring 6 preferably is rigidly arranged on the engine analogously to the axial fan 1, i.e., no relative movements occur between the rotating fan 1 and the stationary guide ring 6 such that a minimal gap can be realized.

FIG. 2 shows a fan 7 that represents a variant of the fan 1 according to FIG. 1, wherein identical components are designated by the same reference symbols as above. The fan 7 essentially corresponds to the fan 1, i.e., it features a similar axial vane arrangement 4 and a similar shroud ring 5. A stationary guide ring 8 is arranged in the region of the setback of the inflow edge 5*a* and is realized conically or in a diffuser-like fashion, i.e., it widens in the flow direction L. The recessed vane tip region 4*c* is adapted to the conical shape of the guide ring 8. Due to the diffuser-like guide ring 8, the essentially semi-axially oriented main flow of the fan 7 is brought into play so that a radial component is added to the flow.

FIG. 3 shows another embodiment example of the invention, in which an axial fan 9 features a shroud 10 with a projecting cylindrical region 10*a* that projects into an inlet nozzle 11 with a U-shaped or C-shaped cross section. A ducted fan of this type with an inlet nozzle is known from the initially cited prior art and generates a gap or nozzle flow that is superimposed on the main flow in the vane tip region and stabilizes it. In contrast to the prior art, the leading edges 4*a* of the fan vanes 4 do not extend up to the inner surface of the shroud 10 so that a gap s in the form of a wedge is formed. In the region on the inflow side, the fan 4 features a free vane tip edge 12 that defines the wedge s and is completely exposed to the inflowing nozzle flow generated by the inlet nozzle 11. An incorrect inflow is prevented by the gap flow with its circumferential component due to the free vane tip edge 12 and the leading vane edge 4*a* that is recessed radially inward.

The embodiment examples according to FIGS. 1 and 2 on the one hand and the embodiment example according to FIG. 3 on the other hand are related due to the basic idea of the invention that the leading edges of the fan vanes stand free in the vane tip region, i.e., they are not shrouded. An incorrect inflow is thereby prevented in both cases.

FIG. 4 shows another embodiment example of the invention with a fan 13 that essentially corresponds to the fans 1 and 7 of the embodiment examples according to FIGS. 1 and 2. One difference can be seen in the design of the guide ring 14 that widens conically or in the shape of a bell fashion opposite to the flow direction L and thereby forms an inlet funnel for the inflowing air. The recessed vane tip region 4*c* is accordingly adapted to this shape of the guide ring 14.

FIG. 5 shows another variant of the preceding embodiment example, i.e., a fan 13 with a stationary guide ring 15 that is arranged upstream of its shroud ring 5 and features a cover ring 15*a* that extends radially inward in its air inlet region. The cover ring 15*a* covers the radial gap between the guide ring 15 and the vane tip region 4*c* of the axial vanes 4.

FIG. 6 shows another embodiment example of the invention with an axial fan 16 that features axial vanes 4 and a shroud ring 5. The guide ring 17 that is realized slightly conically and in a diffuser-like fashion is arranged upstream of the shroud ring 5 and features an inflow edge 17*a* and an outflow edge 17*b*. A radial gap 18 remains between the outflow edge 17*b* of the guide ring 17 and the inflow edge 5*a* of the shroud ring 5, wherein an annular deflecting element 19 that is fixed on the guide ring 17 is assigned to said radial gap. Due to this arrangement, an inlet nozzle is formed that makes it possible to realize a gap or nozzle flow as described in greater detail below in connection with the next embodiment.

FIG. 7 shows another embodiment example of the invention that represents an additional refinement of the embodiment according to FIG. 6. An axial fan 20 features an axial vane arrangement 4 with a shroud ring 5 and an upstream guide ring 21 that is adjoined by an annular surface 22 extending in the axial and the radial direction parallel to the shroud ring 5 in addition to the annular deflecting element 19. The main flow of the fan 20 is indicated by three flow arrows P1, P2, P3 and a gap or nozzle flow is indicated by a fourth arrow P4. An annular gap 23 is located between the outer surface of the shroud ring 5 and the annular surface 22, where air from the pressure side of the fan flows through this annular gap opposite to the main flow direction, and is deflected in the deflecting element 19 and enters the fan 20, i.e., its axial vane arrangement 4, through the radial gap 18. This gap or nozzle flow is designated by the arrow P4 and stabilizes the main flow in the fan. The geometry of the guide ring 21 and of the shroud ring 5 is realized so that a diffuser effect is achieved that deflects the main flow P1, P2, P3 in a radial direction. This is very advantageous with respect to the installation space in motor vehicles that is limited in the axial direction, particularly by the (not-shown) engine block arranged downstream.

FIG. 8 shows an additional refinement of the embodiment example according to FIG. 7, where the annular surface 22 is additionally extended in the axial and the radial direction and carries flow guide elements 24 that cause the fan outflow to be oriented radially. The flow guide elements 24 may be realized in the form of a radial discharge nozzle as described in the older application of the applicant with the official file number xy . . . (reference of the applicant: 06-B-060). This embodiment example makes it possible to realize a relatively lossless, radially oriented outflow from the fan with a compact, axially limited design.

FIG. 9 shows an illustration of the fan flow for an axial fan according to the prior art. The main flow is directed semi-axially as indicated by parallel arrows P. A turbulence W is created in the vane tip region on the inflow side, where this turbulence disturbs the main flow and causes the efficiency of the fan to deteriorate.

FIG. 10 shows a ducted fan with so-called inlet nozzle known from the prior art, where this fan generates a nozzle flow that is indicated by the two outermost arrows D. In comparison with FIGS. 9 and 10, the turbulence W is eliminated with the nozzle flow D. A stable flow is also thereby achieved in the vane tip region.

FIG. 11 shows another flow pattern for the inventive axial fan 1 of the invention according to the embodiment example illustrated in FIG. 1. The flow through the axial vane arrangement 4 extends in the semi-axial direction according to the arrows. A nozzle flow that is indicated by the outermost arrow F is formed between the shroud ring 5 and the stationary guide ring 6. The main flow is also stabilized in the vane tip region due to this arrangement of the invention in connection with the nozzle flow F.

The invention claimed is:

1. An axial fan for conveying cooling air for a cooling device of a motor vehicle, comprising axial vanes that respectively have a leading edge and a trailing edge, as well as a vane tip, and a shroud ring that has an inflow edge and an outflow edge and is connected to the vane tips, wherein the inflow edge of the shroud ring is set back relative to the leading edges of the axial vanes in the flow direction (L); and a stationary guide ring arranged upstream of the shroud ring relative to the flow direction in region (X1) of the set back, wherein the guide ring is essentially conical and widens in the flow region.

2. The axial fan according to claim 1, wherein the vane tips have a diameter D1 that is reduced in comparison with the diameter of the shroud ring in the region (X1) of the set back.

3. The axial fan according to claim 1, wherein the guide ring has a diameter D2 that is smaller than the diameter of the shroud ring (5).

4. The axial fan according to claim 1, wherein the guide ring comprises an inflow edge that is arranged upstream of the leading edges of the axial vanes relative to the flow direction.

5. The axial fan according to claim 1, wherein the outflow edge of the shroud ring is set forward relative to the trailing edges of the axial vanes in the flow direction.

6. The axial fan according to claim 1, further comprising an annular deflecting element arranged on the guide ring, wherein the annular deflecting element has an outside diameter that is larger than the diameter of the inflow edge of the shroud ring.

7. The axial fan according to claim 6, wherein the deflecting element is extended with an annular surface that extends essentially parallel to the outer surface of the shroud ring so that a radial gap remains.

8. An axial fan for conveying cooling air for a cooling device of a motor vehicle, comprising:

axial vanes that respectively have a leading edge and a trailing edge, as well as a vane tip, and a shroud ring that has an inflow edge and an outflow edge and is connected to the vane tips, wherein the inflow edge of the shroud ring is set back relative to the leading edges of the axial vanes in the flow direction (L);

a stationary guide ring arranged upstream of the shroud ring relative to the flow direction in region (X1) of the set back, wherein the guide ring comprises an inflow edge that is arranged upstream of the leading edges of the axial vanes relative to the flow direction; and an annular deflector element, in the form of a cover ring, arranged on the inflow edge of the guide ring.

9. An axial fan for conveying cooling air for a cooling device of a motor vehicle, comprising:

axial vanes that respectively have a leading edge and a trailing edge, as well as a vane tip, and a shroud ring that has an inflow edge and an outflow edge and is connected to the vane tips, wherein the inflow edge of the shroud ring is set back relative to the leading edges of the axial vanes in the flow direction (L);

a stationary guide ring arranged upstream of the shroud ring relative to the flow direction in region (X1) of the set back;

an annular deflecting element arranged on the guide ring, wherein the annular deflecting element has an outside diameter that is larger than the diameter of the inflow edge of the shroud ring and is extended with an annular surface that extends essentially parallel to the outer surface of the shroud ring so that a radial gap remains; and flow guide elements, in the form of a radial discharge nozzle, arranged on the downstream end of the annular surface.

* * * * *